US012044025B1

(12) United States Patent
Radhs

(10) Patent No.: US 12,044,025 B1
(45) Date of Patent: Jul. 23, 2024

(54) GROUND POST SUPPORT AND LEVEL DEVICE

(71) Applicant: Michael Radhs, Eutawville, SC (US)

(72) Inventor: Michael Radhs, Eutawville, SC (US)

( * ) Notice: Subject to any disclaimer, the term of this patent is extended or adjusted under 35 U.S.C. 154(b) by 175 days.

(21) Appl. No.: 17/844,809

(22) Filed: Jun. 21, 2022

(51) Int. Cl.
*E04H 12/22* (2006.01)
*E04H 12/34* (2006.01)

(52) U.S. Cl.
CPC ..... *E04H 12/2284* (2013.01); *E04H 12/347* (2013.01)

(58) Field of Classification Search
CPC .... E04H 12/2284; E04H 12/347; F16M 11/32
See application file for complete search history.

(56) References Cited

U.S. PATENT DOCUMENTS 1,217,606 A * 2/1917 Kane ..... E21B 19/24 248/676
4,438,896 A * 3/1984 Hall ..... F16M 11/16 248/168
5,002,252 A * 3/1991 Setala ..... A47G 33/12 248/533
5,192,055 A 3/1993 Griggs
6,419,201 B1 * 7/2002 Hughes, Jr. ..... F16M 11/242 248/514
8,991,777 B2 3/2015 Madril
D770,061 S 10/2016 Carn
2009/0090836 A1 * 4/2009 Harris ..... E04H 12/2215 248/545
2015/0108318 A1 * 4/2015 Orr ..... E04H 12/2284 248/523

FOREIGN PATENT DOCUMENTS

WO 2016036259 3/2016

* cited by examiner

*Primary Examiner* — Andrew J Triggs
(74) *Attorney, Agent, or Firm* — Kyle A. Fletcher, Esq.

(57) ABSTRACT

The ground post support and level device includes a collar, a plurality of legs, and a plurality of post clamps. The ground post support and level device may retain a post upright within a post hole dug into the ground while concrete is poured and sets in the post hole. A plurality of levels located within the collar may aid in aligning the post to be vertical. The plurality of post clamps may removably couple the collar to the post. The plurality of legs may extend from the collar to the ground to elevate the collar and provide clearance for pouring the concrete.

19 Claims, 4 Drawing Sheets

GROUND POST SUPPORT AND LEVEL DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fence installation tools, more specifically, a ground post support and level device.

SUMMARY OF INVENTION

The ground post support and level device comprises a collar, a plurality of legs, and a plurality of post clamps. The ground post support and level device may retain a post upright within a post hole dug into the ground while concrete is poured and sets in the post hole. A plurality of levels located within the collar may aid in aligning the post to be vertical. The plurality of post clamps may removably couple the collar to the post. The plurality of legs may extend from the collar to the ground to elevate the collar and provide clearance for pouring the concrete. As a non-limiting example, the post may be a 4 inch×4 inch fence post.

An object of the invention is to hold a post upright in a vertical orientation while concrete is mixed, poured into the post hole around the base of the post, and sets.

Another object of the invention is to provide a collar and a plurality of clamps to couple the invention to the post.

A further object of the invention is to provide a plurality of levels to determine when the collar is horizontal and the post is therefore vertical.

Yet another object of the invention is to provide a plurality of legs to elevate the collar and to provide clearance around the post hole, each of the legs comprising an adjustable foot operable to level the collar.

These together with additional objects, features and advantages of the ground post support and level device will be readily apparent to those of ordinary skill in the art upon reading the following detailed description of the presently preferred, but nonetheless illustrative, embodiments when taken in conjunction with the accompanying drawings.

In this respect, before explaining the current embodiments of the ground post support and level device in detail, it is to be understood that the ground post support and level device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ground post support and level device.

It is therefore important that the claims be regarded as including such equivalent construction insofar as they do not depart from the spirit and scope of the ground post support and level device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
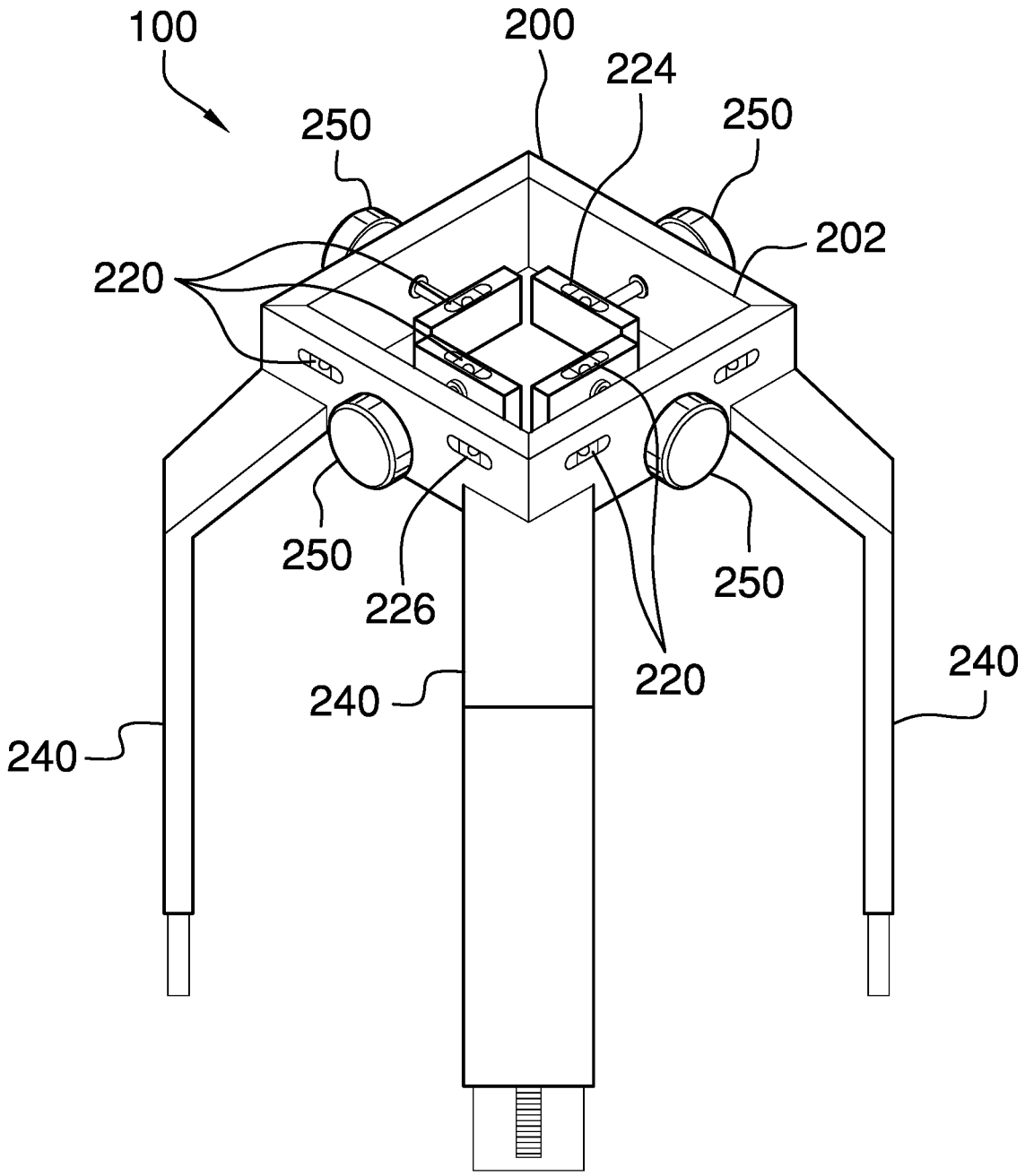
FIG. 1 is an isometric view of an embodiment of the disclosure.
Figure 2:
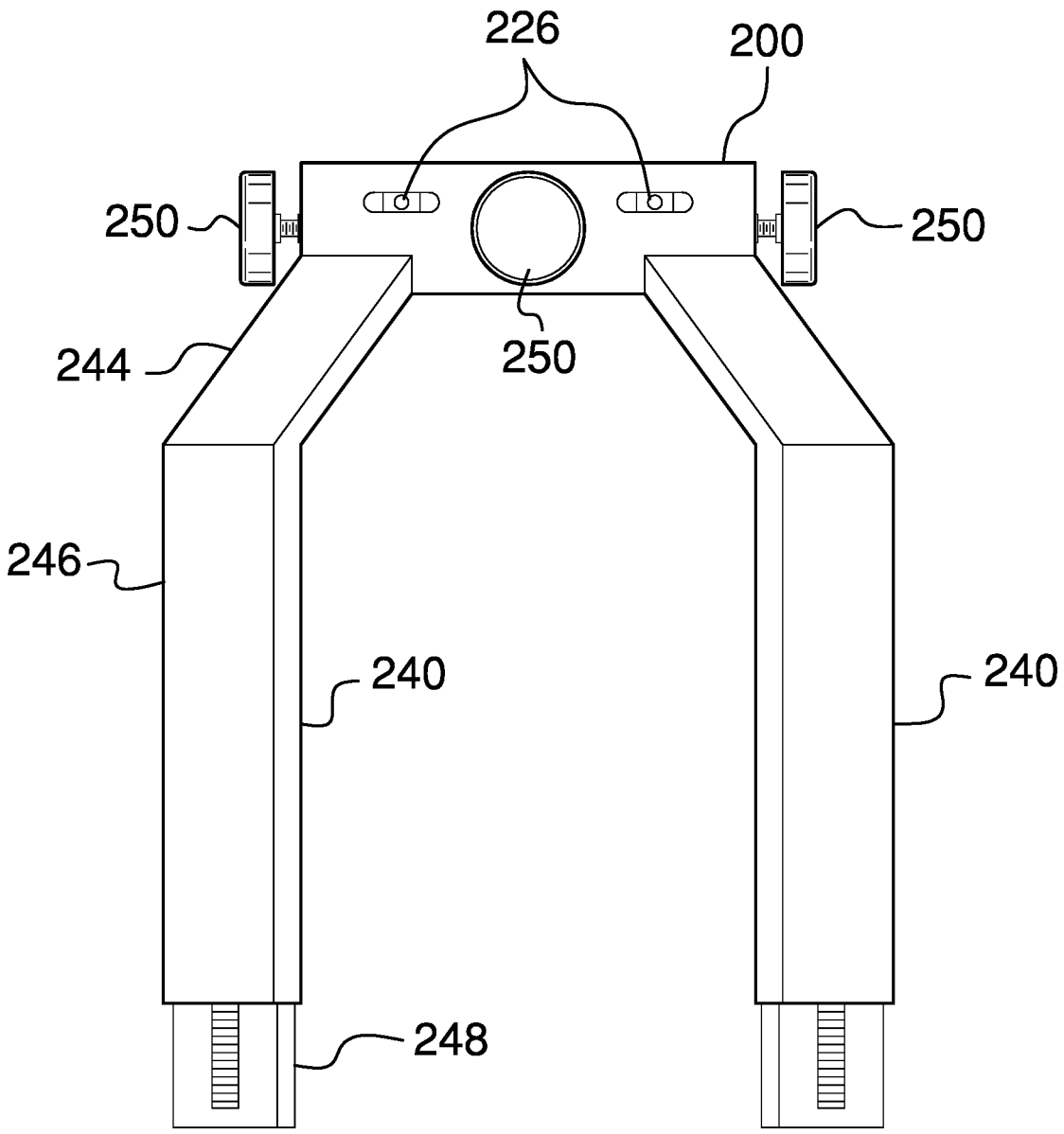
FIG. 2 is a front view of an embodiment of the disclosure.
Figure 3:
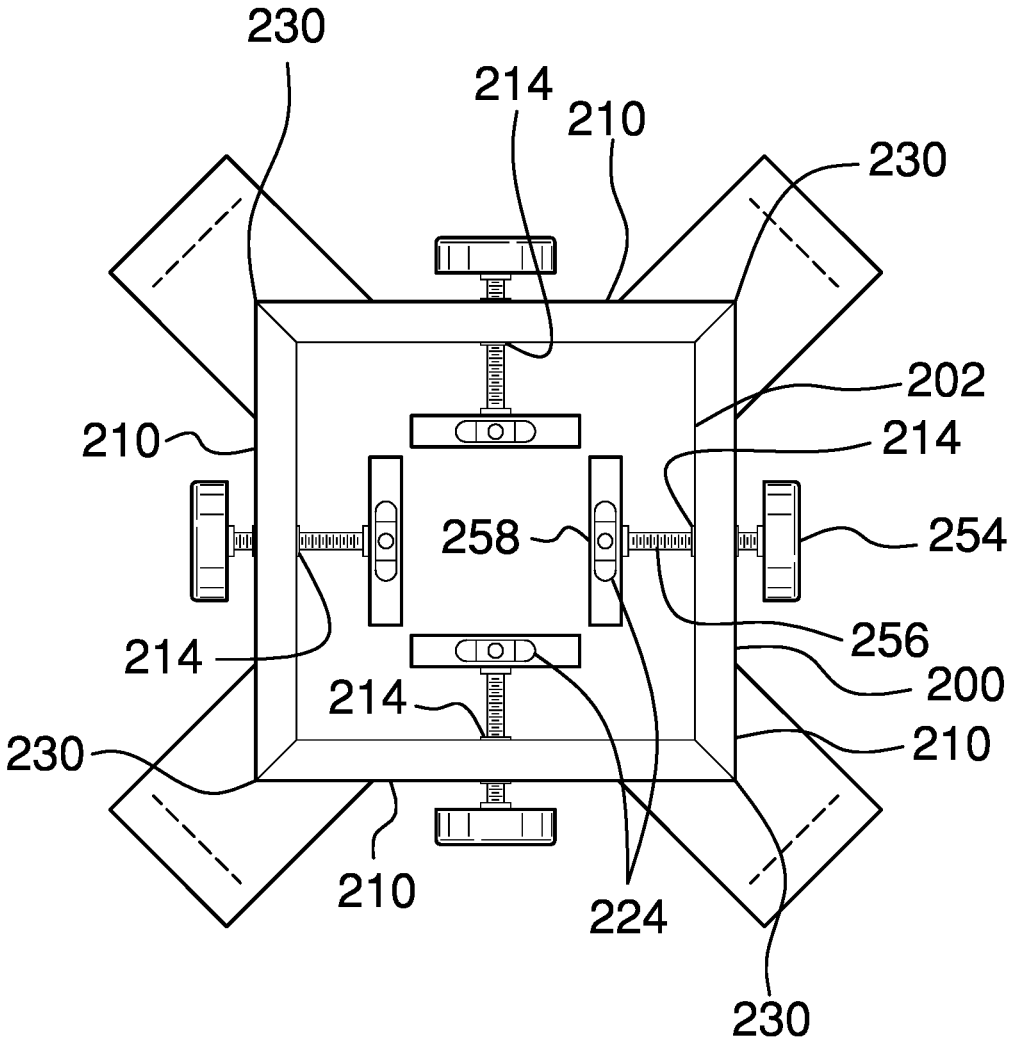
FIG. 3 is a top view of an embodiment of the disclosure.
Figure 4:
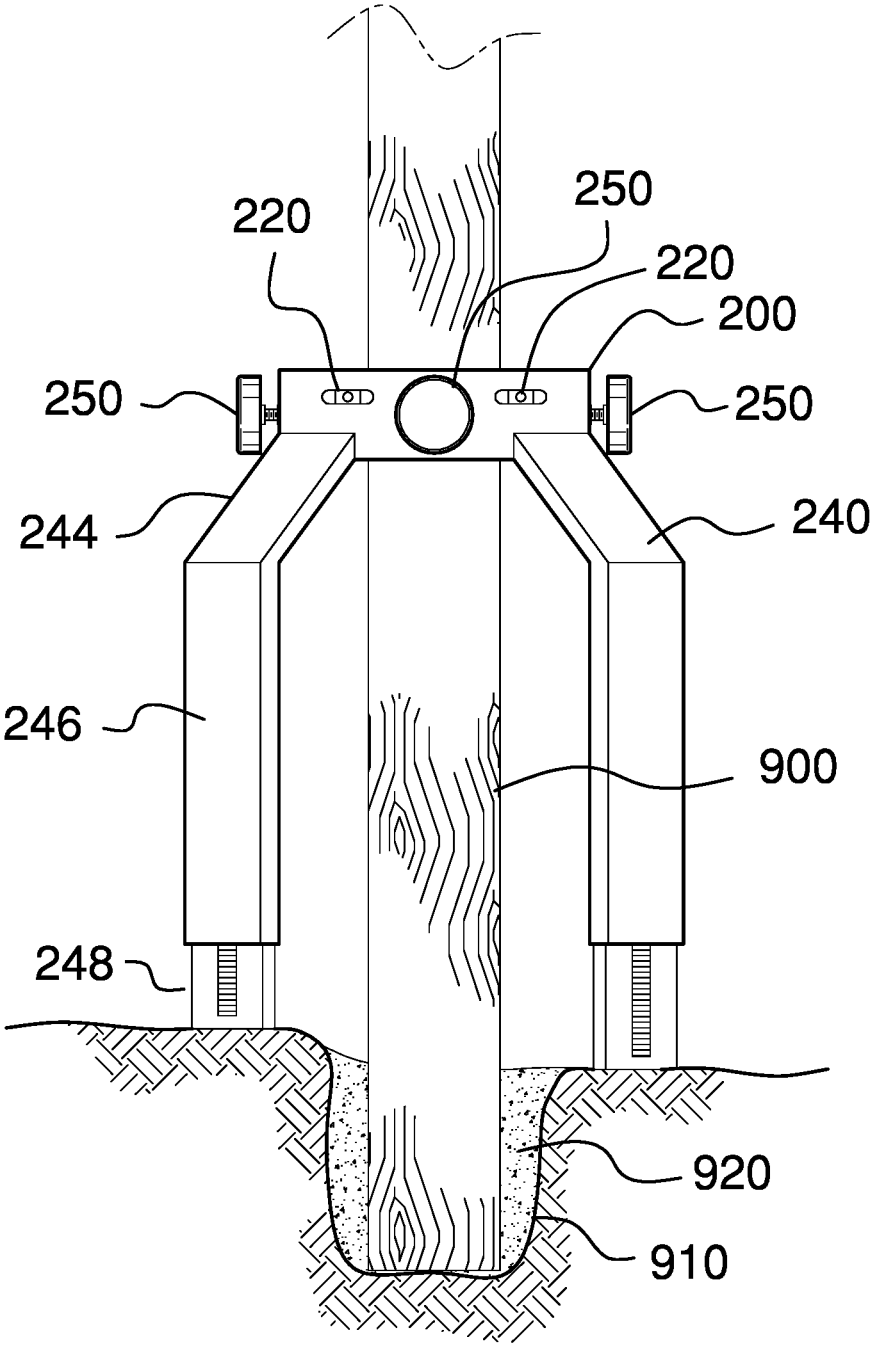
FIG. 4 is an in-use view of an embodiment of the disclosure.

Detailed reference will now be made to a first potential embodiment of the disclosure, which is illustrated in FIGS. 1 through 4.

The ground post support and level device 100 (hereinafter invention) comprises a collar 200, a plurality of legs 240, and a plurality of post clamps 250. The invention 100 may retain a post 900 upright within a post hole 910 dug into the ground while concrete 920 is poured and sets in the post hole 910. A plurality of levels 220 located within the collar 200 may aid in aligning the post 900 to be vertical. The plurality of post clamps 250 may removably couple the collar 200 to the post 900. The plurality of legs 240 may extend from the collar 200 to the ground to elevate the collar 200 and provide clearance for pouring the concrete 920. As a non-limiting example, the post may be a 4 inch×4 inch fence post.

The collar 200 may be a square armature that surrounds the post 900. The center of the collar 200 may be open, forming a post aperture 202 through which the post 900 may pass. The collar 200 may comprise a plurality of collar sides 210 and a plurality of corners 230. The plurality of legs 240 may couple to the collar 200 at the plurality of corners 230.

The plurality of collar sides 210 may comprise a plurality of clamp apertures 214 and the plurality of levels 220. The plurality of post clamps 250 may couple to the collar 200 at the plurality of clamp apertures 214. The plurality of levels 220 may comprise one or more top surface levels 224 visible on a pressure disk 258, and one or more side levels 226 visible on the sides of the plurality of collar sides 210.

An individual collar side selected from the plurality of collar sides 210 may comprise an individual clamp aperture, and at least one of the one or more side levels 226. The individual clamp aperture may be located at the center of the individual collar side and may pass horizontally through the individual collar side. The individual clamp aperture may be threaded.

The plurality of levels 220 may be horizontally-oriented spirit levels. Two of individual levels selected from the plurality of levels 220 may be operable to indicate that the collar 200 is level if the individual levels are perpendicular to each other and both of the individual levels read 'level'. As a non-limiting example, the individual levels may read 'level' if a bubble within each of the individual levels is centered between marks on the tube of the individual levels.

The plurality of levels 220 may be dispersed over all of the plurality of collar sides 210 such that the plurality of levels 220 may be adapted to be visible to a user from any position around the post 900. The one or more top surface levels 224 may be dispersed on the tops of the pressure disks 258 so that the one or more top surface levels 224 may be visible when in use with a post 900. The one or more side levels 226 may be dispersed on the sides of the plurality of collar sides 210 so that the one or more side levels 226 may be visible from ground level.

The plurality of legs 240 may be coupled to the collar 200 at the plurality of corners 230. The plurality of legs 240 may elevate the collar 200 and may provide access to the post hole 910.

An individual leg selected from the plurality of legs 240 may comprise an upper leg 244 and a lower leg 246. The top of the upper leg 244 may couple to an individual corner of the collar 200. The bottom of the upper leg 244 may be coupled to the top of the lower leg 246. The upper leg 244 may extend down and away from the collar 200 at an oblique angle. The upper leg 244 may position the lower leg 246 away from the footprint of the collar 200 to provide the clearance for pouring the concrete 920. The lower leg 246 may be vertically-oriented.

The lower leg 246 may comprise an adjustable foot 248. The adjustable foot 248 may extend from and retract into the bottom of the lower leg 246 to adjust the overall height of the individual leg to match the ground such that the collar 200 may be leveled.

The plurality of post clamps 250 may removably couple the collar 200 to the post 900. An individual post clamp selected from the plurality of post clamps 250 may comprise a threaded shaft 256, an adjustment knob 254, and the pressure disk 258. The adjustment knob 254 may be coupled to one end of the threaded shaft 256 and the pressure disk 258 may be coupled to the opposite end of the threaded shaft 256. The threaded shafts 256 pass through the plurality of clamp apertures 214 on the collar 200. The threaded shaft 256 may be threaded with a thread that complements the threading of the plurality of clamp apertures 214 such that rotation of the threaded shaft 256 within the individual clamp aperture may cause the threaded shaft 256 to move towards the center of the collar 200 or away from the center of the collar 200 depending upon the direction of rotation.

The adjustment knob 254 may be adapted to be grasped by the user in order to rotate the individual post clamp.

The pressure disk 258 may present a flat surface that may press against the post 900. The flat surface of the pressure disk 258 may be perpendicular to the threaded shaft 256 and may therefore align the post 900 to be perpendicular to the collar 200 when the plurality of post clamps 250 are tightened against the post 900.

The plurality of post clamps 250 may work in pairs with two of the individual post clamps pressing on the post 900 from the front and rear and two of the individual post clamps pressing on the post 900 from the sides. Because the plurality of post clamps 250 operate independently of each other, the invention 100 may be operable to couple to a non-square post if the separation distance between the pair of clamps pressing on the front and rear of the non-square post differs from the separation distance between the pair of clamps pressing on the sides of the non-square post.

The dimensions of the collar 200 may be such that the post aperture 202 is larger than the width of the largest post plus the thickness of two of the pressure disks 258.

In use, the plurality of post clamps 250 may be rotated to move the plurality of post clamps 250 away from the center of the collar 200. The post 900 may be set into the post hole 910 and the invention 100 may be lowered onto the post 900 such that the post 900 passes through the post aperture 202 at the center of the collar 200 and at least one of the plurality of legs 240 touches the ground. The plurality of post clamps 250 may be tightened against the post 900. The post 900 may be moved within the post hole 910 and may be tilted in various directions until the plurality of levels 220 indicate that the collar 200 is level and the post 900 is against one or more mason's lines if used to align the posts 900. When the plurality of levels 220 indicate that the collar 200 is level then the post 900 is vertical. The adjustable foot 248 on each of the plurality of legs 240 may be extended or retracted as needed while maintaining the collar 200 in a level orientation such that all of the plurality of legs 240 make contact with the ground. The post 900 may then be released and may maintain a vertical orientation supported by the invention 100 while the concrete 920 is mixed, poured into the post hole 910 around the base of the post 900, and sets. When the concrete 920 has set, the plurality of post clamps 250 may be loosened and the invention 100 may be removed from the post 900.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface or object. Aperture may be synonymous with hole, slit, crack, gap, slot, or opening.

As used herein, "complement" or "complementary" may refer to a compatibility between threaded parts such that the gender, handedness, form, angle, pitch, diameter, and thread depth of both threads are compatible for the parts to mate by screwing the threads together. "Complement" and "complementary" may also be used to describe compatibility between geared parts and/or combinations of geared parts and threaded parts. As a non-limiting example, the worm screw and worm gear of a worm drive mechanism may be said to be complementary if the worm screw meshes with the worm gear and the worm screw is operable to turn the worm gear when the worm screw rotates.

As used herein, the words "couple", "couples", "coupled" or "coupling", may refer to connecting, either directly or indirectly, and does not necessarily imply a mechanical connection.

As used here, "footprint" may refer to a projection of an object onto the surface that supports the object. The projection is usually, but not always, vertically downward.

As used herein, "front" may indicate the side of an object that is closest to a forward direction of travel under normal use of the object or the side or part of an object that normally presents itself to view or that is normally used first. "Rear" or "back" may refer to the side that is opposite the front.

Unless noted otherwise, "ground" may refer to any surface which may support items and individuals. As non-limiting examples, ground may refer to an earthen surface whether covered by vegetation or not, a floor, a tarmac, a driveway, a road, a deck, bedrock, or a stage. The phrase "from the ground" may refer to performing an activity while standing on such a surface as opposed to climbing a ladder.

As used in this disclosure, "horizontal" may be a directional term that refers to a direction that is perpendicular to the local force of gravity. Unless specifically noted in this disclosure, the horizontal direction is always perpendicular to the vertical direction.

As used herein, "oblique angle" may refer to any angle that is not a right angle or a multiple of a right angle.

As used in this disclosure, "orientation" may refer to the positioning and/or angular alignment of a first object relative to a second object or relative to a reference position or reference direction.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ground post support and level device comprising:
a collar, a plurality of legs, and a plurality of post clamps;
wherein the ground post support and level device retains a post upright within a post hole dug into the ground while concrete is poured and sets in the post hole;
wherein a plurality of levels located within the collar and on the plurality of post clamps in order to aid in aligning the post to be vertical.

2. The ground post support and level device according to claim 1
wherein the collar is a square armature that surrounds the post;
wherein a center of the collar is open, forming a post aperture through which the post passes;
wherein the collar comprises a plurality of collar sides and a plurality of corners;
wherein the plurality of legs couple to the collar at the plurality of corners.

3. The ground post support and level device according to claim 2
wherein the plurality of collar sides comprise a plurality of clamp apertures and a portion of the plurality of levels;
wherein the plurality of post clamps couple to the collar at the plurality of clamp apertures;
wherein the plurality of levels comprise one or more top surface levels that are positioned and visible on the plurality of post clamps and are positioned and visible on the sides of the plurality of collar sides.

4. The ground post support and level device according to claim 3
wherein an individual collar side selected from the plurality of collar sides comprises an individual clamp aperture, and at least one of the one or more side levels;
wherein the individual clamp aperture is located at a center of the individual collar side and passes horizontally through the individual collar side.

5. The ground post support and level device according to claim 4
wherein the individual clamp aperture is threaded.

6. The ground post support and level device according to claim 5
wherein the plurality of levels are horizontally-oriented spirit levels;
wherein two of individual levels selected from the plurality of levels are operable to indicate that the collar is level if the individual levels are perpendicular to each other and both of the individual levels read 'level'.

7. The ground post support and level device according to claim 6
wherein the plurality of levels are dispersed over all of the plurality of collar sides such that the plurality of levels are adapted to be visible to a user from any position around the post;
wherein the one or more top surface levels are dispersed on the plurality of post clamps so that the one or more top surface levels are visible when in use with a post;
wherein the one or more side levels are dispersed on the sides of the plurality of collar sides so that the one or more side levels are visible from ground level.

8. The ground post support and level device according to claim 7
wherein the plurality of legs elevate the collar and provide access to the post hole.

9. The ground post support and level device according to claim 8 wherein an individual leg selected from the plurality of legs comprises an upper leg and a lower leg;

wherein the top of the upper leg couples to an individual corner of the collar;

wherein the bottom of the upper leg is coupled to the top of the lower leg.

10. The ground post support and level device according to claim 9 wherein the upper leg extends down and away from the collar at an oblique angle;

wherein the upper leg positions the lower leg away from a footprint of the collar to provide a clearance for pouring the concrete.

11. The ground post support and level device according to claim 10 wherein the lower leg is vertically-oriented.

12. The ground post support and level device according to claim 11 wherein the lower leg comprises an adjustable foot;

wherein the adjustable foot extends from and retracts into a bottom of the lower leg to adjust an overall height of the individual leg to match the ground such that the collar is leveled.

13. The ground post support and level device according to claim 12 wherein the plurality of post clamps removably couple the collar to the post;

wherein an individual post clamp selected from the plurality of post clamps comprises a threaded shaft, an adjustment knob, and a pressure disk;

wherein the adjustment knob is coupled to one end of the threaded shaft and the pressure disk is coupled to an opposite end of the threaded shaft.

14. The ground post support and level device according to claim 13 wherein the threaded shaft is threaded with a thread that complements the threading of the plurality of clamp apertures such that rotation of the threaded shaft within the individual clamp aperture causes the threaded shaft to move towards the center of the collar or away from the center of the collar depending upon a direction of rotation.

15. The ground post support and level device according to claim 14 wherein the adjustment knob is adapted to be grasped by the user in order to rotate the individual post clamp.

16. The ground post support and level device according to claim 15 wherein the pressure disk presents a flat surface that presses against the post;

wherein the flat surface of the pressure disk is perpendicular to the threaded shaft and therefore aligns the post to be perpendicular to the collar when the plurality of post clamps are tightened against the post;

wherein the one or more top surface levels are provided on the pressure disk of each of the plurality of post clamps.

17. The ground post support and level device according to claim 16 wherein the plurality of post clamps work in pairs with two of the individual post clamps pressing on the post from a front and a rear and two of the individual post clamps pressing on the post from its sides.

18. The ground post support and level device according to claim 17 wherein the ground post support and level device is operable to couple to a non-square post if a separation distance between the pair of clamps pressing on a front and a rear of the non-square post differs from a separation distance between the pair of clamps pressing on a sides of the non-square post.

19. The ground post support and level device according to claim 17 wherein dimensions of the collar is such that the post aperture is larger than a width of the largest post plus a thickness of two of the pressure disks.

* * * * *